US007497226B2

(12) United States Patent
Li et al.

(10) Patent No.: US 7,497,226 B2
(45) Date of Patent: Mar. 3, 2009

(54) WALKER

(75) Inventors: Qinfeng Li, Foshan (CN); Sam Liang, Foshan (CN)

(73) Assignee: Genteel Home Care Products Co. Ltd, Foshan (CN)

( * ) Notice: Subject to any disclaimer, the term of this patent is extended or adjusted under 35 U.S.C. 154(b) by 0 days.

(21) Appl. No.: 11/870,664

(22) Filed: Oct. 11, 2007

(65) Prior Publication Data

US 2008/0308137 A1 Dec. 18, 2008

(30) Foreign Application Priority Data

Jun. 13, 2007 (CN) ..... 2007 2 0052713 U

(51) Int. Cl.
*A45B 9/02* (2006.01)
*A61H 3/00* (2006.01)

(52) U.S. Cl. ..... 135/74; 135/67; 135/75

(58) Field of Classification Search ..... 135/67, 135/74

See application file for complete search history.

(56) References Cited

U.S. PATENT DOCUMENTS

2004/0187901 A1* 9/2004 Diamond ..... 135/67
2005/0236025 A1* 10/2005 Gale et al. ..... 135/74
2006/0278260 A1* 12/2006 Su ..... 135/67

FOREIGN PATENT DOCUMENTS

WO WO 9917707 A1 * 4/1999

* cited by examiner

*Primary Examiner*—David Dunn
*Assistant Examiner*—Danielle Jackson
(74) *Attorney, Agent, or Firm*—Lucas & Mercanti, LLP

(57) ABSTRACT

A walker comprises: a cross brace having an end sleeve on each end, N-shaped leg extensions, a lock body having a housing and a block having an axis hole, wherein the leg extension is covered by the end sleeve, the lock body is provided on top of the end sleeve, the leg extension and the lock body are provided with a pin hole and a connecting pin hole respectively at corresponding positions and fixed by a lock pin, the housing of the lock body is provided with a hole for sub axis, the block is connected inside the housing by a sub axis passing through the hole for sub axis and the axis hole, the end sleeve is provided with an orientation hole, a flange for fitting with the orientation hole is provided at the bottom of the block in the housing, a stretch part with a bearing rod is provided inside the leg extension, and the bearing rod leans against the upper portion of the block above the axis hole by passing through a through hole on the leg extension. The invention of this walker is of simple structure and assembly, easy processing and folding, light weight, convenient to transportation and storage. It meets of the demands of different users.

18 Claims, 6 Drawing Sheets

WALKER

BACKGROUND OF THE INVENTION

The present invention relates to a walking aid, more particularly to a locking mechanism for use in a frame walker. Frame walking aids has been used to help the disabled or the old with mobility to increase their independence, and it is of great importance to their life. Most of the walking aids are foldable and easy for transportation and storage. However, the structure is rather complex and not easy for the user to operate, and due to its high weight and price, it is to not as widely used as expectation.

SUMMARY OF THE INVENTION

It is an object of the present invention to provide a walker with simple structure, which is easy for the user to operate and could be used widely.

The technical solution of the invention is as follows: a walker includes a cross brace having an end sleeve on each end, N-shaped leg extensions, a lock body having a housing and a block having an axis hole. The leg extension is covered by the end sleeve. The lock body is provided on top of the end sleeve. The leg extension and the lock body are provided with a pin hole and a connecting pin hole respectively, which is fixed by the lock pin. There are holes on the lock body of the housing, and the block is connected inside the housing by the sub axis passing through the sub axis hole and the axis hole. The orientation hole on the end sleeve fits with the flange at the bottom of the block. There is a stretch part with a bearing rod is provided inside the leg extension, and the bearing rod reaches the block of axis hole through the through hole on the leg extension.

The two leg extensions are assembled within the end sleeves on the two ends of the cross bar. A lock body is provided outside the end sleeve, and the lock body is fixed with the leg extension, and thus the lock body and the leg extension could rotate simultaneously with respect to the end sleeve. The block is connected to the lock body through the sub axis, the flange at the bottom of the block fits into the orientation hole of the end sleeve, and the bearing rod of the stretch part leans against the upper portion of the block above the axis hole, which forms the lever. When the walker is used, under the elastic force, the flange at the bottom of the block moves into the orientation hole, and thus the leg extension and the end sleeves are fixed together. When the walker is folded, with an inward push force acting on the block, the stretch part is strained, and the flange departs from the orientation hole on the end sleeve. The leg extension and the lock body can be rotated inside the end sleeves so as to fold the walker. The structure is simple, lightweight and easy to fold/unfold.

A bushing having an orientation pin hole is provided between the lock body and the leg extension and is fixed by the lock pin. The clearance between the lock body and the leg extension is adjustable, which allows the leg extension to go through the lock body.

On top of the bushing, there is a limit slot through which the block could be inserted. The outer wall of the bushing is provided with a through hole for the bearing rod to go through, which is convenient for assembling the block.

The bushing is provided with a glide slot on outer wall of the bottom, and a corresponding protrusion is provided on the top inner wall of the end sleeve. By fixing the protrusion with the glide slot, the rotation between the leg extension and cross brace can be limited during folding, which is easy for adjustment.

The top of the end sleeve is bugle-shaped, which is easy to allow the leg extension go through.

There is an actuating lever or a transversal lever or a longitudinal lever outside the block, which can be adjusted according to the users' needs.

The leg extension is adjustable so as to adjust the height of the walker, which help more people with different height.

The invention of this walker is of the advantages including simple structure and assembly, easy processing and folding, light weight, convenient to transportation and storage. It meets the demands of different users.

1—cross bar; 2—end sleeve; 3—lock body; 4—block; 5—leg extension; 6—lock housing; 7—connecting pin hole; 8—pin hole; 9—lock pin; 10—hole for sub axis; 11—axis hole; 12—sub axis; 13—flange; 14—through hole; 15—bushing; 16—through hole; 17—orientation hole; 18—orientation pin hole; 19—limit slot; 20—glide slot; 21—stretch part; 22—bearing rod; 23—protrusion; 24—glide slot; 25—actuating lever; 26—transversal lever; 27—longitudinal lever; 28—connect pin

DETAILED DESCRIPTION OF THE INVENTION

Embodiment 1

Figure 1:
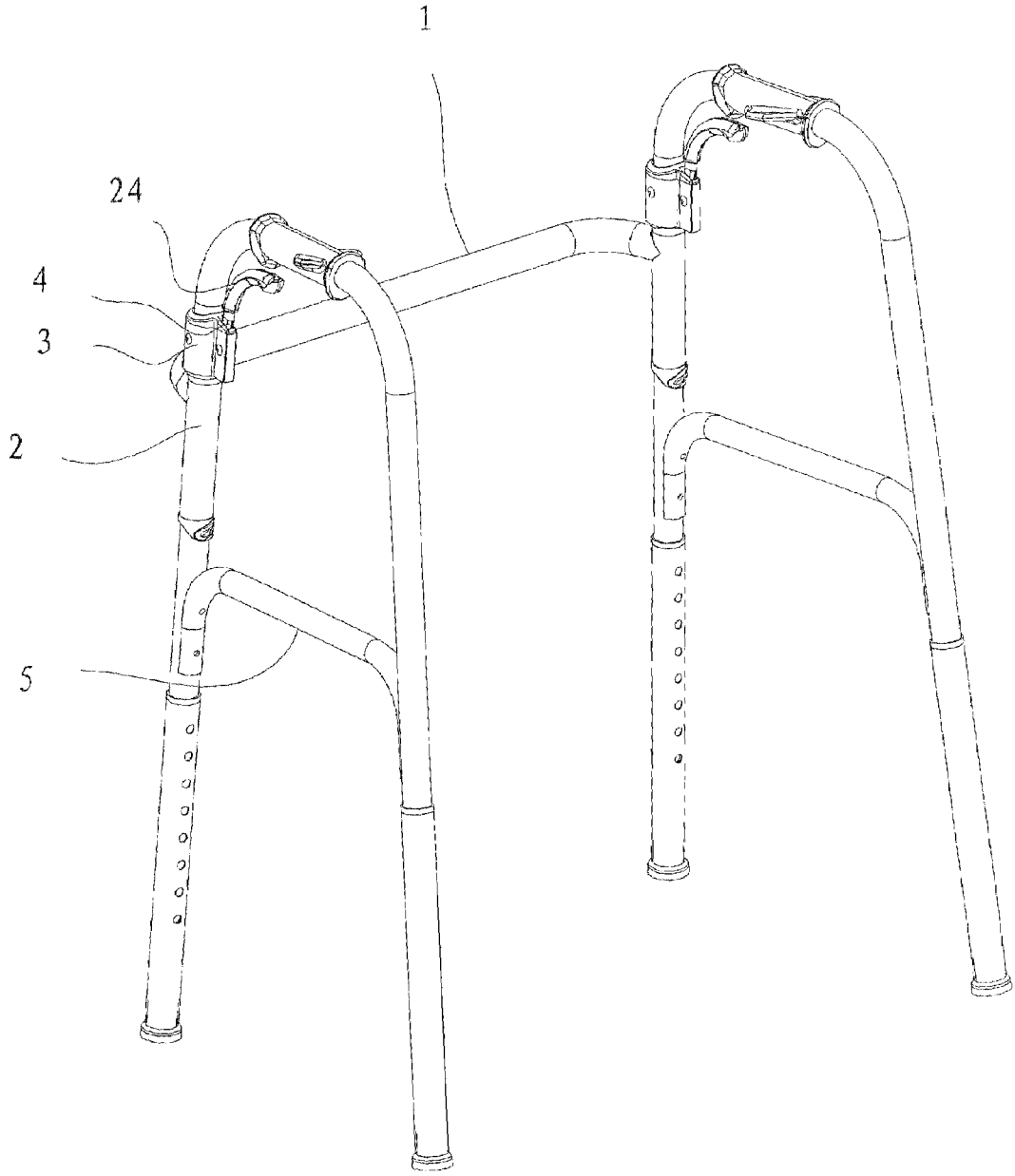
FIG. 1 shows the structure of the first embodiment of the present Invention.
Figure 2:
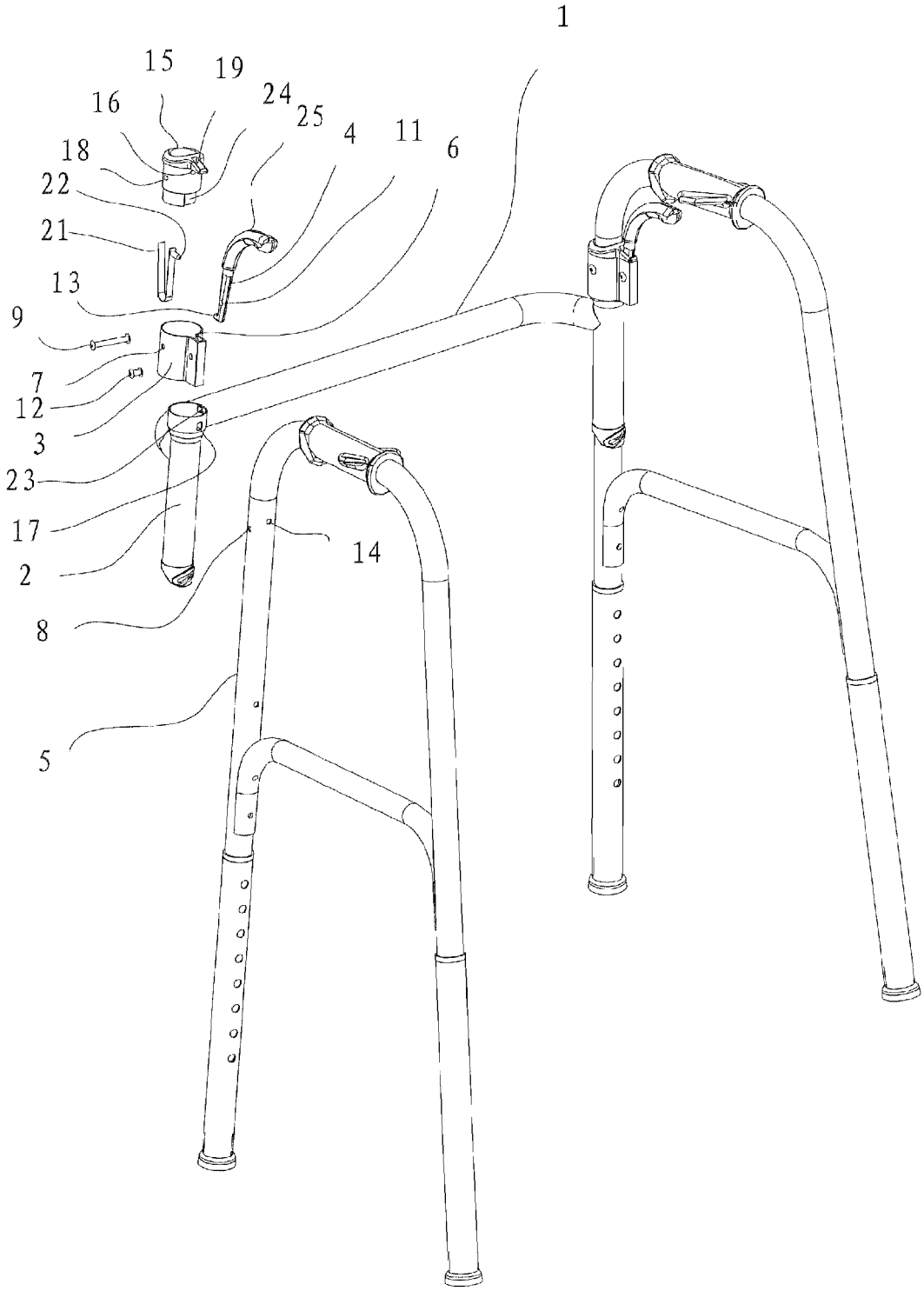
FIG. 2 shows the detailed structure of the first embodiment of the present Invention.
Figure 3:
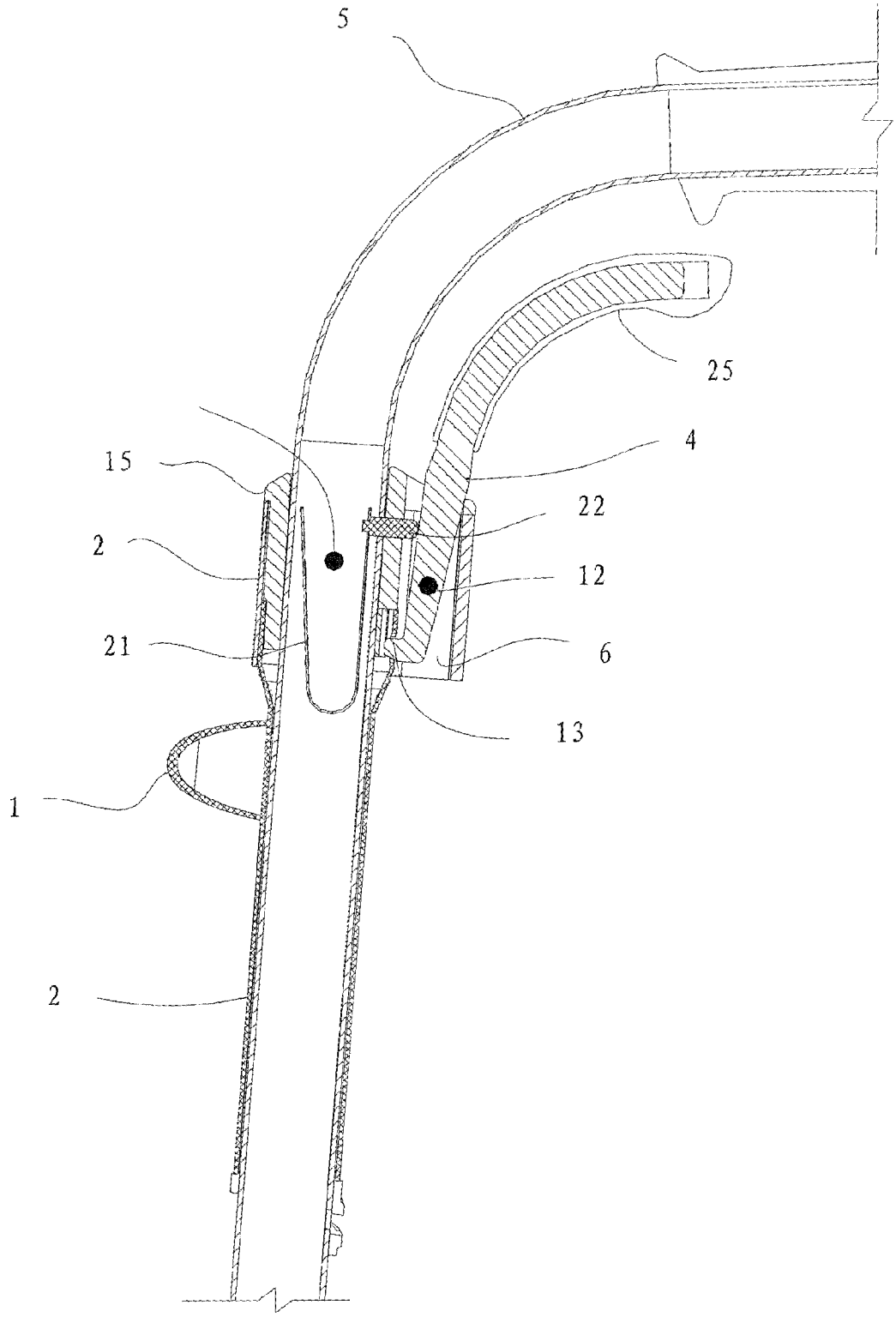
FIG. 3 shows the cutaway view of the joint portion on the first embodiment of the present Invention.
Figure 4:
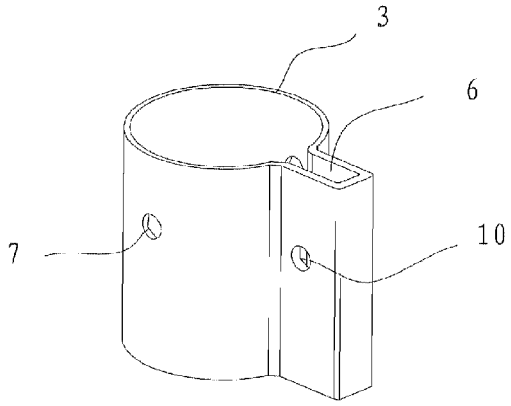
FIG. 4 shows the exploded view of the Lock body of the first embodiment of the present invention.
Figure 5:
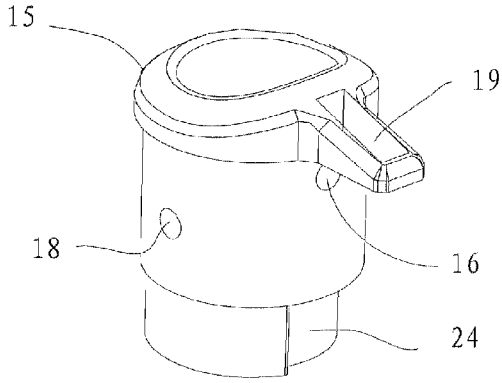
FIG. 5 shows the exploded view of the bushing of the first embodiment of the present invention.
Figure 6:
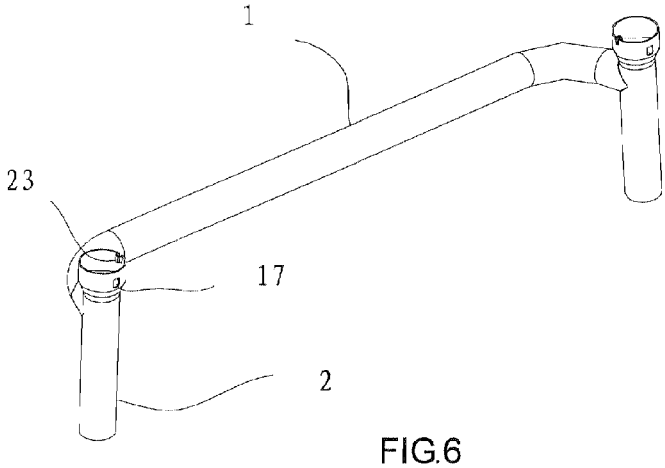
FIG. 6 shows the exploded view of the cross brace of the first embodiment of the present invention.
Figure 7:
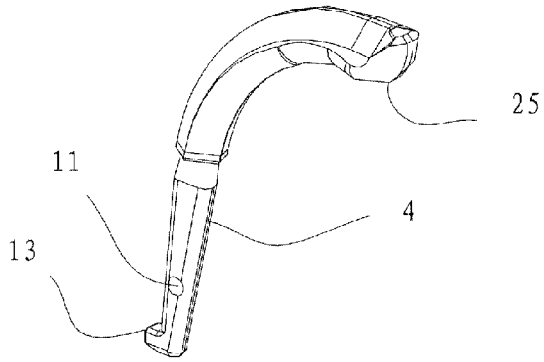
FIG. 7 shows the exploded view of the block of the first embodiment of the present invention.
Figure 8:
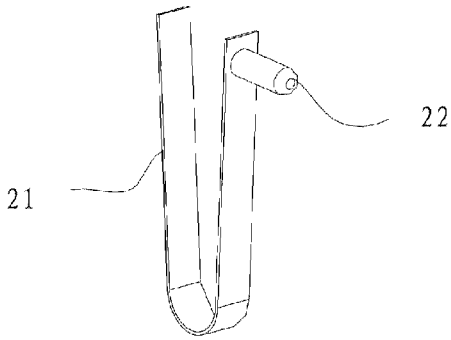
FIG. 8 shows the exploded view of the stretch part of the first embodiment of the present invention.

The walker, as shown in FIGS. 1, 2 and 3, includes an end sleeve 2 on each end of the cross brace 1, N-shaped leg extension 5, a lock body 3 having a housing 6 and a block 4 having an axis hole 11. The leg extension 5 is covered by the end sleeve 2. The lock body 3 is provided on top of the end sleeve 2. A pin hole 8 is provided on the leg extension 5. There is a corresponding connecting pin hole 7 on the lock body 3. A bushing 15 having an orientation pin hole 18 is provided between the leg extension 5 and the lock body 3. With the lock pin 9 going through the connecting pin hole 7, the orientation pin hole 18 and the pin hole 8, the lock body 3 and the bushing 15 are fixed on the leg extension 5. Referring to FIG. 4, the lock body 3 of the housing 6 has a hole for sub axis 10. Referring to FIG. 5, on top of bushing 15, a limit slot 19 through which the lock 4 can be inserted is provided. The block 4 is connected within the lock housing 6 by the sub axis 12 passing through the hole for sub axis 10 and the axis hole 11. An orientation hole 17 is provided on the end sleeve 2. Referring to FIG. 7, the orientation hole 17 fits with a flange 13 at the bottom of the block 4 in the lock housing 6. As shown in FIG. 8, a stretch part 21 with a bearing rod 22 is provided inside the leg extension 5, and the bearing rod 22 reaches the upper portion of the block 4 above the axis hole 11 by passing through the through hole 14 on the leg extension 5. Referring to FIG. 5 and FIG. 6, on the outer wall of the bushing 15, a through hole 16 for the bearing rod 22 to go through is provided, and a glide slot 24 is provided on the outside surface of the bottom of the busing 15, and a corresponding protrusion 23 on the top portion of the inner wall of the end sleeve 2 is provided.

The two leg extensions 5 are assembled within the end sleeves 2 on the two ends of the cross bar 1. A lock body 3 is provided outside the end sleeve 2, and the lock body 3 is fixed with the leg extension 5, and thus the lock body 3 and the leg extension 5 could rotate simultaneously with respect to the end sleeve 2. The block 4 is connected to the lock body 3 through the sub axis 12, and the flange 13 at the bottom of the block 4 fits into the orientation hole 17 of the end sleeve 2, and the bearing rod 22 of the stretch part 21 leans against the upper portion of the block 4 above the axis hole 11, which forms the lever. When the walker is used, under the elastic force, the flange 13 at the bottom of the block 4 is inserted into the orientation hole 17, and thus the leg extension 5 and the end sleeves 2 are fixed together. When the walker is folded, with an inward push force acting on the block 4, the stretch part 21 is strained, and the flange 13 departs from the orientation hole 17 on the end sleeve 2. The leg extension 5 and the lock body 3 can be rotated inside the end sleeves 2 so as to fold the walker. The structure is simple, lightweight and easy to fold/unfold.

The top of the end sleeve 2 is bugle-shaped, which is easy to insert the leg extension 5. The bushing 15 is made of flexible material such as plastic, which helps to adjust the clearance between the lock body 3 and the leg extension 5 and to obtain a graceful appearance.

There is an actuating lever 25 for pushing the block 4, which can be designed according to the different needs of users.

In this embodiment, the leg extension 5 is adjustable, and there are through holes on both the inner tubing and the outer tubing, which are locked by a lock pin.

Embodiment 2

Figure 9:
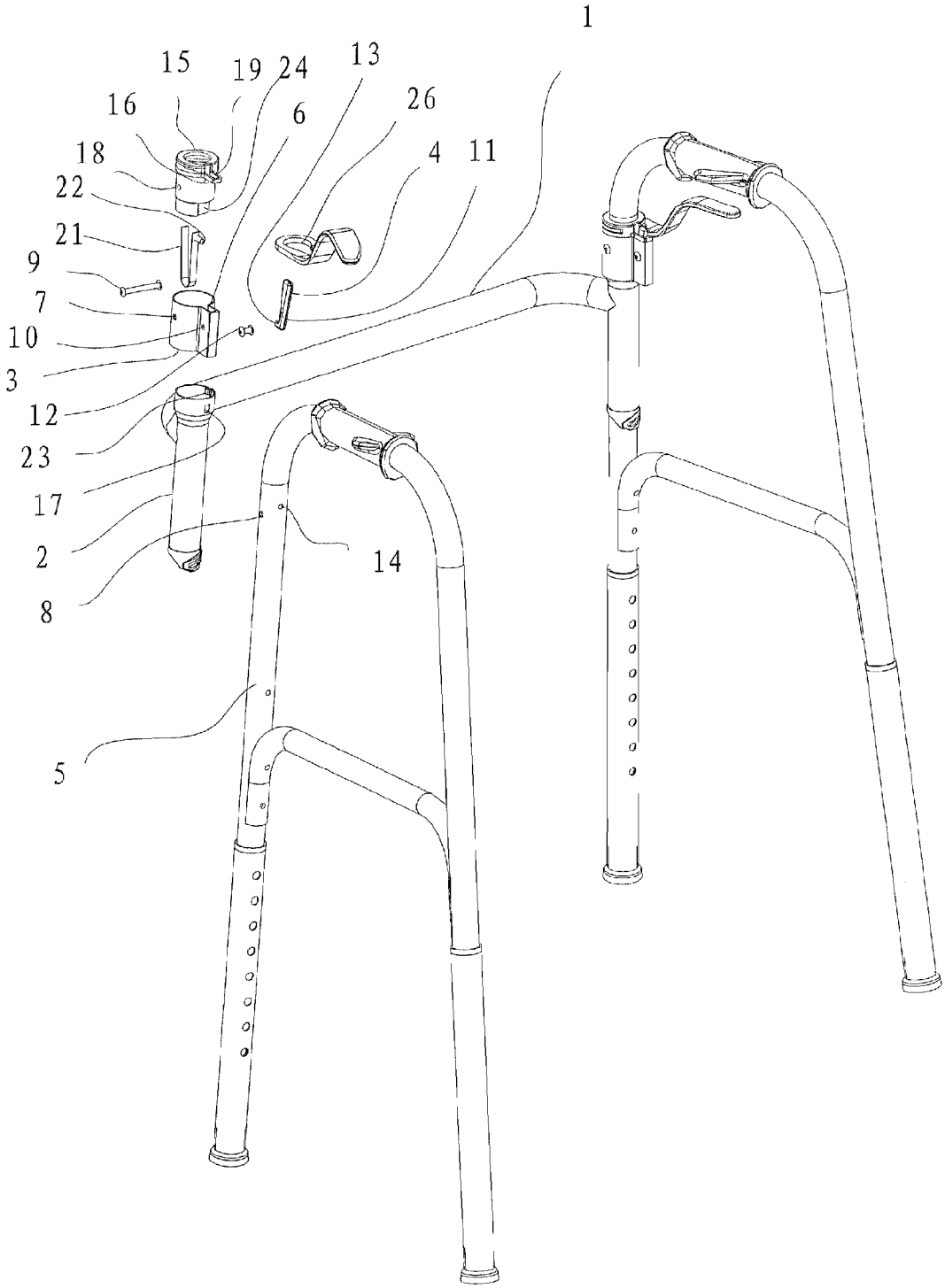
FIG. 9 shows the enlarged exploded view of the second embodiment of the present Invention.

Referring to FIG. 9, the walker includes an end sleeve 2 on both ends of the cross brace 1, N-shaped leg extensions 5, a lock body 3 having a housing 6 and a block 4 having an axis hole 11 on it. The leg extension 5 is covered by the end sleeve 2. The lock body 3 is provided on top of the end sleeve 2. A pin hole 8 is provided on the leg extension 5. There is a corresponding connecting pin hole 7 on the lock body 3. A bushing 15 having an orientation pin hole 18 is provided between the leg extension 5 and the lock body 3. With the lock pin 9 going through the connecting pin hole 7, the orientation pin hole 18 and the pin hole 8, the lock body 3 and the bushing 15 are fixed on the leg extension 5. The lock body 3 of the housing 6 has a hole for sub axis 10. On top of bushing 15, a limit slot 19 through which the lock 4 can be inserted is provided. The block 4 is connected within the lock housing 6 by the sub axis 12 passing through the hole for sub axis 10 and the axis hole 11. An orientation hole 17 is provided on the end sleeve 2. The orientation hole 17 fits with the flange 13 at the bottom of the block 4 in the lock housing 6. A stretch part 21 with a bearing rod 22 is provided inside the leg extension 5, and the bearing rod 22 reaches the upper portion of the block 4 above the axis hole 11 by passing through the through hole 14 on the leg extension 5.

Outside the block 4, there is a transversal lever 26, which can be rotated to move the block 4 inwards, then the flange 13 departs from the orientation hole 17, then the walker is folded. The other technical features are the same as the embodiment 1.

Embodiment 3

Figure 10:
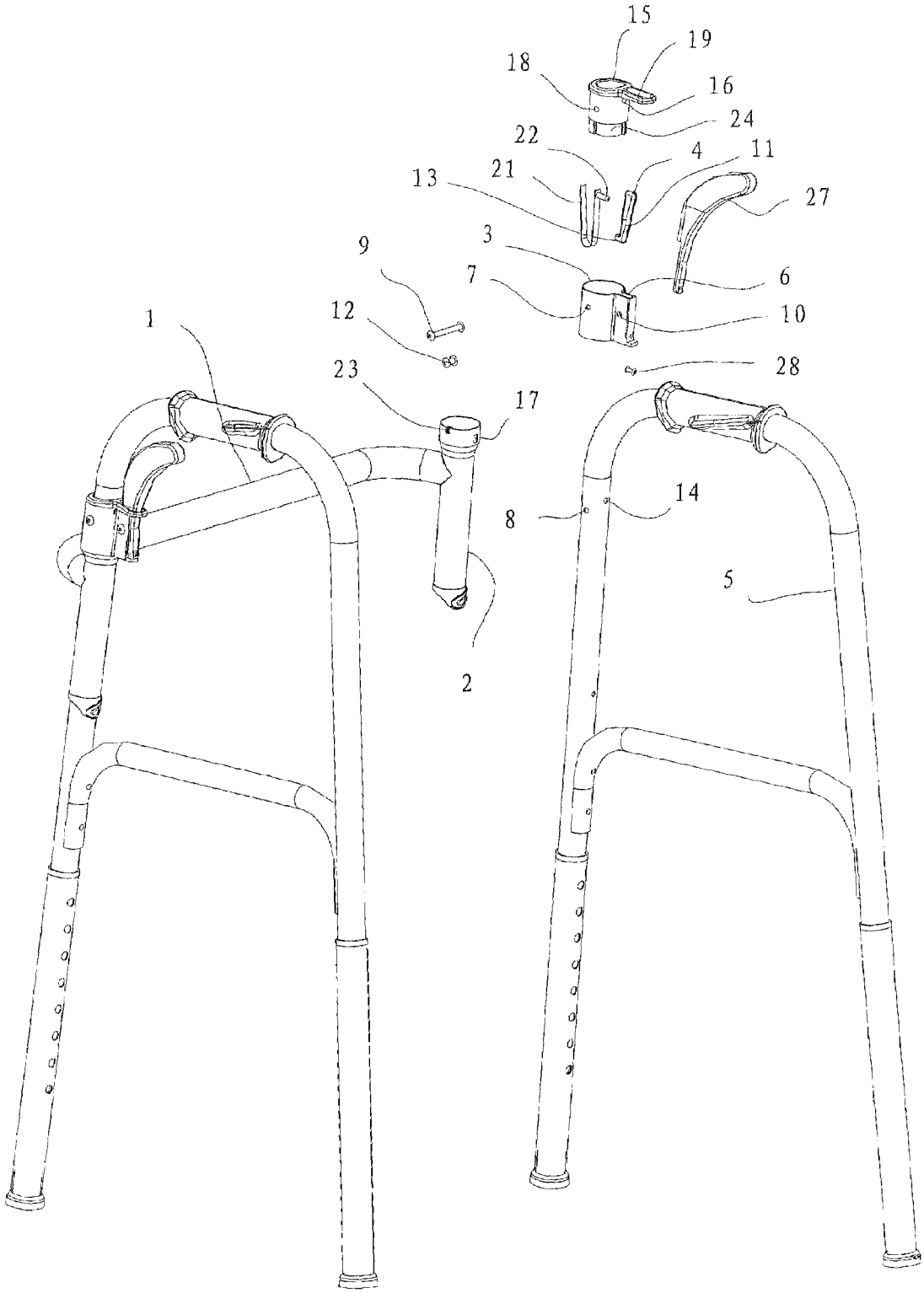
FIG. 10 shows the enlarged exploded view of the third embodiment of the present Invention.

Referring to FIG. 10, the walker includes an end sleeve 2 on both ends of the cross brace 1, N-shaped leg extensions 5, a lock body 3 having a housing 6 and a block 4 having an axis hole 11. The leg extension 5 is covered by the end sleeve 2. The lock body 3 is provided on top of the end sleeves 2. A pin hole 8 is provided on the leg extension 5. There is a corresponding connecting pin hole 7 on the lock body 3. A bushing 15 having an orientation pin hole 18 is provided between the leg extension 5 and the lock body 3. With the lock pin 9 going through the connecting pin hole 7, the orientation pin hole 18 and the pin hole 8, the lock body 3 and the bushing 15 are fixed on the leg extension 5. The lock body 3 of the housing 6 has a hole for sub axis 10. On top of bushing 15, a limit slot 19 through which the lock 4 can be inserted is provided. The block 4 is connected within the lock housing 6 by the sub axis 12 passing through the hole for sub axis 10 and the axis hole 11. An orientation hole 17 is provided on the end sleeve 2. The orientation hole 17 fits with the flange 13 at the bottom of the block 4 in the lock housing 6. A stretch part 21 with a bearing rod 22 is provided inside the leg extension 5, and the bearing rod 22 reaches the upper portion of the block 4 above the axis hole 11 by passing through the through hole 14 on the leg extension 5.

Outside the block 4, there is a longitudinal lever 27, fixed by a connect pin 28 out of the housing 6 of the lock body 3. With a pushing force on the longitudinal lever 27, the block moves inward, then the flange 13 departs from the orientation hole 17, then the walker is folded. The other technical features are the same as the embodiment 1.

The above embodiments are just examples of the present Invention. The embodiments should not limit the range of the invention. Any modification or variation may be made without departing from the spirit of the invention.

What is claimed is:

1. A walker, comprising: a cross brace having an end sleeve on each end, N-shaped leg extensions, a lock body having a housing and a block having an axis hole, wherein the leg extension is covered by the end sleeve, the lock body is provided on top of the end sleeve, the leg extension and the lock body are provided with a pin hole and a connecting pin hole respectively at corresponding positions and fixed by a lock pin, the housing of the lock body is provided with a hole for sub axis, the block is connected inside the housing by a sub axis passing through the hole for sub axis and the axis hole, the end sleeve is provided with an orientation hole, a flange for fitting with the orientation hole is provided at the bottom of the block in the housing, a stretch part with a bearing rod is provided inside the leg extension, and the bearing rod leans against the upper portion of the block above the axis hole by passing through a through hole on the leg extension.

2. The walker according to claim 1, wherein a bushing with pin holes is provided between the lock body and the leg extension and fixed by the lock pin.

3. The walker according to claim 2, wherein the bushing is provided with a limit slot for inserting the block, the outer wall of the bushing is provided with a through hole for inserting the bearing rod.

4. The walker according to claim 3, wherein the bushing is provided with a glide slot on the bottom outer wall, and a corresponding protrusion is provided on the top inner wall of the end sleeve.

5. The walker according to claim 2, wherein the top of the end sleeve is bugle-shaped.

6. The walker according to claim 3, wherein the top of the end sleeve is bugle-shaped.

7. The walker according to claim 1, wherein the block is provided with an actuating lever or a transversal lever or a longitudinal lever.

8. The walker according to claim 2, wherein the block is provided with an actuating lever or a transversal lever or a longitudinal lever.

9. The walker according to claim 3, wherein the block is provided with an actuating lever or a transversal lever or a longitudinal lever.

10. The walker according to claim 4, wherein the block is provided with an actuating lever or a transversal lever or a longitudinal lever.

11. The walker according to claim 5, wherein the block is provided with an actuating lever or a transversal lever or a longitudinal lever.

12. The walker according to claim 6, wherein the block is provided with an actuating lever or a transversal lever or a longitudinal lever.

13. The walker according to claim 7, wherein the leg extension is adjustable.

14. The walker according to claim 8, wherein the leg extension is adjustable.

15. The walker according to claim 9, wherein the leg extension is adjustable.

16. The walker according to claim 10, wherein the leg extension is adjustable.

17. The walker according to claim 11, wherein the leg extension is adjustable.

18. The walker according to claim 12, wherein the leg extension is adjustable.

* * * * *